United States Patent [19]

LaPlaca

[11] Patent Number: 4,787,941

[45] Date of Patent: Nov. 29, 1988

[54] CLEANING METHOD FOR KEYBOARD ASSEMBLIES

[75] Inventor: Joseph P. LaPlaca, Merrimack, N.H.

[73] Assignee: Wang Laboratories, Inc., Lowell, Mass.

[21] Appl. No.: 880,437

[22] Filed: Jun. 30, 1986

[51] Int. Cl.[4] ..... B08B 3/12

[52] U.S. Cl. ..... 134/1; 134/25.1; 134/25.4; 134/26; 134/39

[58] Field of Search ..... 134/1, 25.1, 25.4, 26, 134/39, 40, 29, 30, 36, 37, 84, 94

[56] References Cited

U.S. PATENT DOCUMENTS

| | | | |
|---|---|---|---|
| 2,121,361 | 6/1938 | Marran | 184/1 |
| 3,448,747 | 6/1969 | Isaacson | 134/120 |
| 3,527,607 | 9/1970 | Antonevich | 134/1 |
| 3,898,351 | 8/1987 | Kennison | 427/57 |
| 3,901,726 | 8/1975 | Snearly | 134/1 |
| 3,904,430 | 9/1975 | Tipping et al. | 134/26 |
| 4,023,984 | 5/1977 | Clementson et al. | 134/1 |
| 4,132,567 | 1/1979 | Blackwood | 134/1 |
| 4,138,306 | 2/1979 | Niwa | 134/1 |
| 4,182,687 | 1/1980 | Barlett | 252/DIG. 17 |
| 4,269,630 | 5/1981 | Stephenson et al. | 134/26 |
| 4,543,130 | 9/1985 | Shwartzman | 134/1 |
| 4,581,101 | 4/1986 | Senoue et al. | 134/1 |

FOREIGN PATENT DOCUMENTS

| | | | |
|---|---|---|---|
| 2448253 | 4/1976 | Fed. Rep. of Germany | 134/25.4 |
| 2541613 | 3/1977 | Fed. Rep. of Germany | 134/25.4 |
| 0010239 | 1/1982 | Japan | 134/25.4 |

*Primary Examiner*—H. M. S. Sneed
*Assistant Examiner*—Sharon T. Cohen
*Attorney, Agent, or Firm*—Michael H. Shanahan

[57] ABSTRACT

A method for cleaning keyboards having Hall-effect, plunger-type keys that comprises the steps of immersing the keyboard in a mild detergent bath, subjecting this bath to ultrasonic vibrations, removing the keyboard from this bath, rinsing the detergent solution from the keyboard, and drying the keyboard by immersing said keyboard in a fluorinated solvent or baking said keyboard in a low temperature oven.

20 Claims, No Drawings

CLEANING METHOD FOR KEYBOARD ASSEMBLIES

BACKGROUND OF THE INVENTION

Of many techniques developed for entering data into computers, calculators and other, similar devices, one of the most common is through the use of a keyboard. In the most general sense, a keyboard is a data entry device in communication with a parent data storage or processing apparatus which comprises a plurality of key type switches, each assigned a distinct and independent value. When depressed, each key switch has its distinct, independent value entered into the parent apparatus. When released, the key resets, returning to its normal position.

Keyboard mechanisms vary greatly, with two of the most common types being the Capacitance or Serial type in which polyurethane foam pads press against aluminum foil interleaves to complete a circuit, and the Plunger or Hall Effect type in which a small electrical current is produced by moving a magnet through a coil, the origin of this current indicating to the parent device which key has been depressed.

Among the most common materials employed for plunger-type keyboard structures are ABS (acrylonitrile butadiene styrene) and modified phenylene oxide plastics. These are used not only in the case and key cap assemblies, but additionally in the housings and actuators for the key switches. The key mechanism also includes a spring assembly to provide upward pressure on the key switch, thereby allowing it to return to its resting position once depressed. Due to the minimal space available for each key switch; the housing, actuator and spring assembly must operate within very close tolerances.

Keyboards used in both work and home environments are subject to various contaminants ranging from dust and smoke particles to residue from spilled coffee and soft-drinks. Consequently, a periodic refurbishment and cleaning of the keyboard is often necessary. Additionally, residue left by the manufacturing process may make it desirable to clean the keyboard prior to packaging.

Due to the complicated surface geometry, the solvent sensitive plastic materials used in keyboard actuators and housings and the fragile nature of the keyboard, cleaning has proven to be an arduous and time consuming task. Currently, keyboards are cleaned by removing them from their protective covers, spraying on a mild detergent solution, scrubbing them with toothbrushes and similar tools, and then wiping them off. There are no rinse operations or other techniques employed to remove the resulting detergent film. Consequently, the film remains in the voids and hollows inside each key and causes problems such as sticking keys, poor electrical contact, etc. Furthermore, as the problem may not be immediately apparent or detectable by routine testing, a service call is often necessary when a cleaning induced failure occurs once the keyboard has been sent out into the field.

While it would seem desirable to find other methods of keyboard cleaning, none previously have been found that are both effective and harmless. Various chemical baths have been used to clean printed circuit boards and other components, however, keyboard manufacturers have recommended against using these techniques due to the undesirable effects of the currently-used harsh chemicals on the solvent-sensitive keyboard plastics. As a result, slow and problem-causing scrubbing continues to be used.

SUMMARY OF THE INVENTION

This invention relates to a novel process for cleaning keyboards having plunger-type, Hall-effect keys. The process eliminates the time consuming hand-scrubbing technique as well as the possibility of subsequent sticking and poor electrical contact within the key. Furthermore, this process readily lends itself to automation resulting in reduced labor requirements and greater uniformity of results.

Specifically, this process involves the steps of removing the keyboard from its protective cover, immersing it in a mild detergent solution, subjecting it to ultrasonic frequency waves, rinsing it with cold water, and finally, drying it by immersing it in a fluorinated bath or by baking it in a low temperature oven. The resulting keyboard is cleaned of contamination and free of the sticky, problem-causing detergent film. It may then be reassembled in its protective cover and shipped out into the field.

DETAILED DESCRIPTION OF THE INVENTION

The steps and details of the improved keyboard cleaning process are disclosed below.

Once its protective cover has been removed, the keyboard assembly, comprising a plurality of Hall effect, plunger type key switches, each having a housing, an actuator and a spring mechanism, is immersed into a bath of a mild detergent solution. The best results have been obtained when the detergent is of a nature that doesn't attack the plastics used in the key mechanism. When the detergent solution is maintained at a lukewarm temperature, slightly above ambient, excellent cleaning has resulted. Ideally, the detergent should be of a mild variety, and there are many different acceptable types commercially available. It is both desirable and feasible to immerse a plurality of keyboards simultaneously as a means of increasing the efficiency of the operation.

While immersed in the detergent bath, the keyboard is subjected to vibrations of an ultrasonic frequency. The level of these vibrations may vary from 60 to 85 dB, with lower levels being desirable. Ideally, the lowest level which gives adequate cleaning should be employed. Ultrasonic vibrations are used because they provide physical energy to otherwise inaccessible regions of the keyboard.

Even though ultrasonic vibrations have previously been used for cleaning items such as printed circuit boards, they have not been used to clean keyboards for various reasons. These include the need to isolate the solvent-sensitive plastics from harsh detergent baths, the inherent fragility of the keyboard, and the difficulty in drying the complicated surface geometry of the device.

After approximately 1 minute in the detergent bath, the keyboard is removed from the bath and rinsed to completely remove the detergent solution. This is preferably accomplished using a 3 cascade bath with cold, de-ionized water being preferred as a rinsing agent. A cascade bath is used for rinsing because of its desirable properties of continuous circulation and constant filtration. After being rinsed by immersion in each tank, undergoing a total rinse time of approximately one minute, the keyboard is ready to be dried.

Once removed from the rinse baths, excess water may be blown from the keyboard using air-knives. Removal of the remaining water may be accomplished by immersing the keyboard into a water absorbing, fluorinated solvent bath. Freon-based materials have proven successful, with trichlorotrifluoroethane (U.S. Pat. No. 4,182,687) marketed by DuPont as Freon® TDFC being preferred. The selection of the fluorinated solvent is critical, as it must be compatible with the plastics used in keyboards having plunger-type, Hall-effect keys for which this technique is best suited. As most keyboards of this type employ both ABS (acrylonitrile butadiene styrene) and modified phenylene oxide plastics in their mechanism, a fluorinated solvent that will not damage either of these plastics is necessary. After extensive investigation, Freon® TDFC has been found to be preferred for minimizing or eliminating stress cracking and other types of solvent attack on the plastics of the keyboard mechanism. Ideally, the solvent bath should be kept at ambient temperature with the keyboard immersed in the bath for approximately 4 to 6 minutes. This will allow a time long enough for complete removal of water from all internal workings and short enough to prevent the solvent from damaging the plastics contained in the keyboard mechanism.

Alternately, the keyboard may be dried using a low temperature oven rather than a fluorinated solvent. In this alternate embodiment, after being blown by air knives, the keyboard is placed in an oven at 130° to 160° F. for approximately 15 minutes. This allows complete drying with no risk of solvent damage.

Once the keyboard has been cleaned and dried, it is replaced in its protective cover. While removal of the cover during the process is not mandatory, it is desirable as it allows quicker and more complete drying. Rather than being cleaned by hand scrubbing, the cover may also be cleaned by this same process.

It should finally be noted that this cleaning process is very compatible with the human work environment. There are no toxic caustic or carcinogenic chemicals employed, and the physical energies used are all relatively benign. Thus, this process is ideally suited for use in areas where restriction of personnel is a problem.

Those skilled in the art will recognize, or be able to ascertain employing no more than routine experimentation, many equivalents to the specific components, steps and materials described specifically herein, and such equivalents are intended to be encompassed within the scope of the following claims.

I claim:

1. A process for cleaning data entry keyboards, said keyboards having plunger-type, Hall-effect keys, the process comprising the steps of:

(a) immersing the keyboard in a mild aqueous detergent solution;

(b) subjecting said keyboard and solution to ultrasonic vibration;

(c) removing the detergent from the keyboard; and (d) drying said keyboard.

2. The process of claim 1, wherein the keyboard is dried by immersing said keyboard in a water-absorbing fluorinated solvent.

3. The process of claim 1, wherein the keyboard is dried by immersing said keyboard in trichlorotrifluoroethane.

4. The process of claim 1, wherein the keyboard is dried by immersing said keyboard in a water-absorbing fluorinated solvent for four to six minutes.

5. The process of claim 1, wherein the keyboard is dried by immersing said keyboard in a water-absorbing fluorinated solvent wherein said solvent is maintained at ambient temperature.

6. The process of claim 1, wherein the keyboard is dried by inserting said keyboard into an oven.

7. The process of claim 1, wherein the keyboard is dried by inserting said keyboard into an oven operated at a temperature of between 130° and 160° F.

8. The process of claim 1, wherein the keyboard is dried by inserting said keyboard into an oven for approximately fifteen minutes.

9. The process of claim 1, wherein the keyboard is blown with air prior to drying.

10. The process of claim 1, wherein the ultrasonic vibration is at a level of approximately 60 to 85 dB.

11. The process of claim 1, wherein the ultrasonic vibration is at a level of approximately 60 to 70 dB.

12. The process of claim 1, wherein the ultrasonic vibration is at a level of approximately 80 to 82 dB.

13. The process of claim 1, wherein the mild aqueous detergent solution is maintained at a lukewarm temperature.

14. The process of claim 1, wherein the keyboard is immersed in the mild aqueous detergent solution for approximately one minute.

15. The process of claim 1, wherein the detergent is removed from the keyboard by rinsing said keyboard with de-ionized water.

16. The process of claim 1, wherein the detergent is removed from the keyboard by rinsing said keyboard in a 3-tank cascade system.

17. The process of claim 1, wherein the detergent is removed from the keyboard by immersing said keyboard into each tank of a 3-tank cascade system.

18. The process of claim 1, wherein the detergent is removed from the keyboard by rinsing said keyboard with water for approximately one minute.

19. A process for cleaning data entry keyboards, said keyboards having plunger-type, Hall-effect keys, the process comprising the steps of:

(a) immersing the keyboard in a mild aqueous detergent solution;

(b) subjecting said keyboard and solution to ultrasonic vibration at a level of approximately 60 to 85 dB;

(c) removing the detergent from the keyboard by rinsing the keyboard with water; and (d) immersing said keyboard into a water-absorbing fluorinated solvent.

20. A process for cleaning data entry keyboards, said keyboards having plunger-type, Hall-effect keys, the process comprising the steps of:

(a) immersing the keyboard in a lukewarm, mild, aqueous detergent solution;

(b) subjecting said keyboard and solution to ultrasonic vibration at a level of approximately 60 to 85 dB for approximately one minute;

(c) rinsing said keyboard with cold, de-ionized water for approximately one minute in a three-cascade bath to remove essentially all of the detergent solution;

(d) blowing the keyboard with air-knives to remove excess water; and, (e) immersing said keyboard into a fluorinated solvent maintained at ambient temperature for approximately four to six minutes until essentially all of the rinse medium has been absorbed by the solvent.

* * * * *